United States Patent [19]

Pearson

[11] Patent Number: 5,040,464

[45] Date of Patent: Aug. 20, 1991

[54] CONTROLLED FRAGMENTATION WITH FRAGMENT MIX

[75] Inventor: John Pearson, China Lake, Calif.

[73] Assignee: The United States of America as represented by the Secretary of the Navy, Washington, D.C.

[21] Appl. No.: 803,326

[22] Filed: May 31, 1977

[51] Int. Cl.[5] ..... F42B 12/24

[52] U.S. Cl. ..... 102/493

[58] Field of Search ..... 102/64, 67, 493

[56] References Cited

U.S. PATENT DOCUMENTS

| | | | |
|---|---|---|---|
| 109,600 | 11/1870 | Drake | 102/67 |
| 1,628,527 | 5/1927 | Brandt | 102/49.2 |
| 3,566,794 | 3/1971 | Pearson | 102/67 |
| 3,783,790 | 1/1974 | Polcha | 102/493 |
| 3,799,054 | 3/1974 | LaRocca | 102/491 |
| 3,820,464 | 6/1974 | Dixon | 102/493 |
| 4,068,590 | 1/1978 | Pearson | 102/67 |

FOREIGN PATENT DOCUMENTS

| | | | |
|---|---|---|---|
| 555279 | 3/1975 | Belgium | 102/67 |
| 8915 | 7/1916 | United Kingdom . | |

*Primary Examiner*—Harold J. Tudor

*Attorney, Agent, or Firm*—Melvin J. Sliwka; Sol Sheinbein

[57] ABSTRACT

The fragmenting single walled cylinder disclosed yields a plurality of fragments having shapes and masses according to a predetermined distribution. Fragment yield is controlled by the profile and orientation of internally formed grooves.

6 Claims, 6 Drawing Sheets

CONTROLLED FRAGMENTATION WITH FRAGMENT MIX

BACKGROUND OF THE INVENTION

1. Field of the Invention

This invention pertains to methods of manufacturing fragmenting cases and to the cases manufactured thereby, and more particularly to such methods which utilize shear as the mechanism of fracture.

2. Description of the Prior Art

Fragmentation weapons have utilized fracture grids applied to the internal or external surfaces to provide points of stress concentration for initiating fracture upon warhead detonation. These grids most often take the form of a v-notch cut into the surface of the cylinder. Such notches may fracture in one of two directions of maximum shear stress beginning at the root of the v-notch. Such warheads fracture in an only partially controlled manner, the fracture trajectories occurring in a somewhat random manner. In such a warhead the number and size of resulting fragments varies from warhead to warhead, and therefore the effectiveness of a given warhead against a pre-defined target is less predictable.

SUMMARY OF THE INVENTION

In the present invention the profile and orientation of grooves formed on the interior surface of the single walled cylinder control shear fracture trajectories and permit tailoring of the fragment yield. The groove pattern utilized in a cylindrical warhead is made up of two families of parallel helical grooves which intersect to form a repeating diamond pattern. The diamonds so produced have their major axis-parallel to the longitudinal axis of the cylinder. Also, the individual groove profile is defined by a steep wall and a shallow wall with a sharp root.

Upon detonation of high explosive contained within the warhead, the cylinder fails in shear starting at the root of each groove and following a logarithmic spiral to the outer surface. The non symmetrical profile of the groove determines which of two possible shear trajectories the fracture will take.

By arranging one family of grooves so that each groove in that family has its steep wall adjacent the shallow wall in an adjoining groove, and arranging the second family of grooves so that each groove has a steep wall adjacent a steep wall in an adjoining groove, a pattern of fragmentation will result which yields in equal proportions diamond shaped fragments having a single wing and diamond shaped fragments having three wings. Those fragments having three wings will have a greater mass than will the fragments having a single wing.

By rearranging the profile in the second family of grooves so that in both families the steep side of a given groove is adjacent to the steep side of an adjoining groove, then four characteristic fragment shapes will result. The first fragment shape will be a simple diamond. The second fragment shape will be a diamond having diagonally opposed wings. The third fragment shape will be a mirror image of the second fragment shape. The last fragment shape will be a diamond shape having four wings. In this arrangement, fragment shapes having three different characteristic masses will result.

By controlling the shape and mass of fragments yielded by a given warhead, the warhead designer may optimize the weapon for its intended use, against either light armor, personnel or both. A minimum number of fragments having sufficient mass to damage light armor may be provided by appropriate design. Also, the warhead case may be designed to produce small, although adequately lethal, fragments for use against personnel. Any combination of designs may be used to produce an all purpose weapon.

BRIEF DESCRIPTION OF THE DRAWING

Further advantages of the present invention will emerge from a description which follows of a method of fracture control yielding a plurality of fragment shapes and masses from a single warhead. This description is given with reference to the accompanying drawing figures, in which.

DESCRIPTION OF THE PREFERRED EMBODIMENTS

The present invention represents an improvement over the invention described in the inventor's copending application Ser. No. 67,245, filed Aug. 26, 1970, titled "Means For Controlled Fragmentation" by John Pearson, and now U.S. Pat. No. 4,068,590. The inventor has unexpectedly discovered through further research that not only can shear trajectory be controlled by groove profile, but also that the fragment mass ratios and shapes yielded upon explosive rupture can be controlled by the relative orientation of the grooves. Frangible warheads can now be designed to produce a predetermined ration of fragments of different masses to provide optimum anti-material or anti-personnel action.

Figure 13:
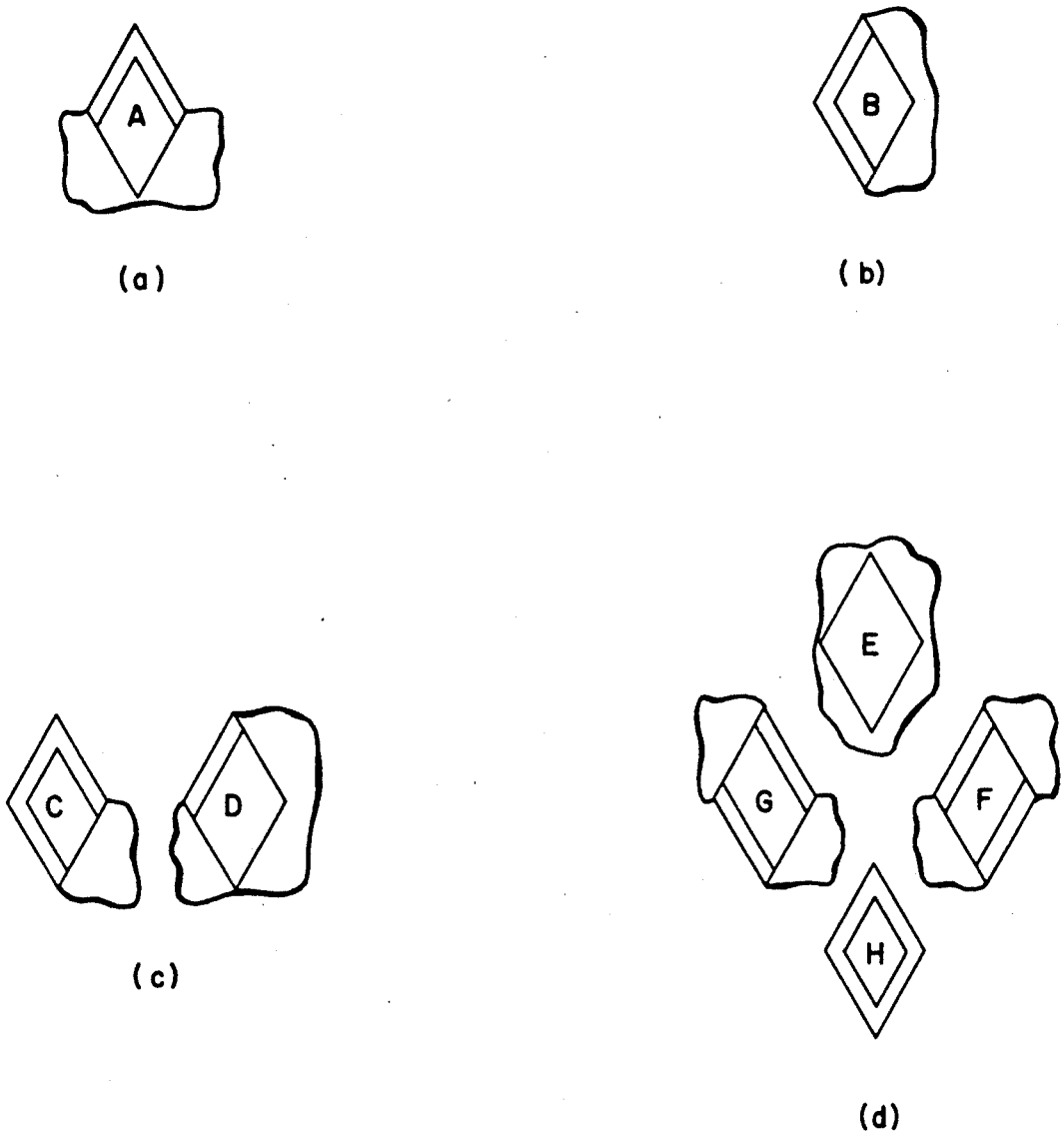
FIG. 13 illustrates possible fragment shapes which may be produced by the present invention.

The grid designs illustrated by FIGS. 1 through 12 produce in varying proportions the fragment shapes designated A, B, C, D, E, F, G, and H in FIG. 13. Throughout the figures, numeral 11 refers to the steep wall of a groove, numeral 12 refers to the shallow wall of a groove, and numeral 13 refers to the root of the groove. FIGS. 1, 4, 7, and 10 illustrate the patterns which may be formed on the inner surface of a cylinder, however, when so formed, the patterns would of course comply with inner surface curvature, as shown by diamond pattern 15 within hollow cylinder 14 in FIG. 14. The patterns could be formed on flat stock which is then rolled to form a cylinder.

As previously described, the inner surface grid system serves as a family of mechanical stress raisers which produce localized stress concentrations in certain geometric patterns of such stress intensity that the fragmentation process is governed by the initiation of shear fractures at the root of the grid elements. Satisfactory grid design to assure breakup of the case into a planned distribution of fragment sizes requires a detailed understanding of how the various design parameters are related to the fragmentation behavior of the case. While the theoretical network for all of the sheer fracture Trajectories which can exist in a warhead case for a specific grid geometry can be pre-determined, actual fracture activation will occur only on a certain percentage of these trajectories. The actual number of trajectories activated, and the relative orientation of the trajectories, will determine the size and shape of the fragments produced and the resulting signature of the fragment mass distribution plot for that warhead.

Some of the more important parameters which influence trajectory activation and which need to be considered in the design of a warhead include (1) the properties of the warhead case material, (2) the basic grid geometry, (3) the cross-sectional profile of the grid element, (4) the orientation of the detonation front, (5) the type of explosive, (6) design considerations such as the presence of buffers between explosive and case, and (7) possible design variables associated with the type of manufacturing process used to produce the grids.

The most important single factor in the use of the shear-control method is the behavioral properties of the case material. Since this method is based on shear fracture as the primary mode of failure, the method works best with ductile steels. The following steels have yielded acceptable results:

SAE1015 Steel having a hardness on the RB scale of 85,

SAE1040 Steel having a hardness on the RC scale of 22,

SAE4142 Steel having a hardness on the RC scale of 22,

SAE52100 Steel having a hardness on the RC scale of 28,

SAE4340 Steel having a hardness on the RC scale of 31, and

HYTUF Steel having a hardness on the RC scale of 40. Marginally, AISI 52100 Steel having a hardness on the RC scale of 46 was acceptable. A steel judged not acceptable was AISI 52100 Steel having a hardness on the RC scale of 60.

Figure 14:
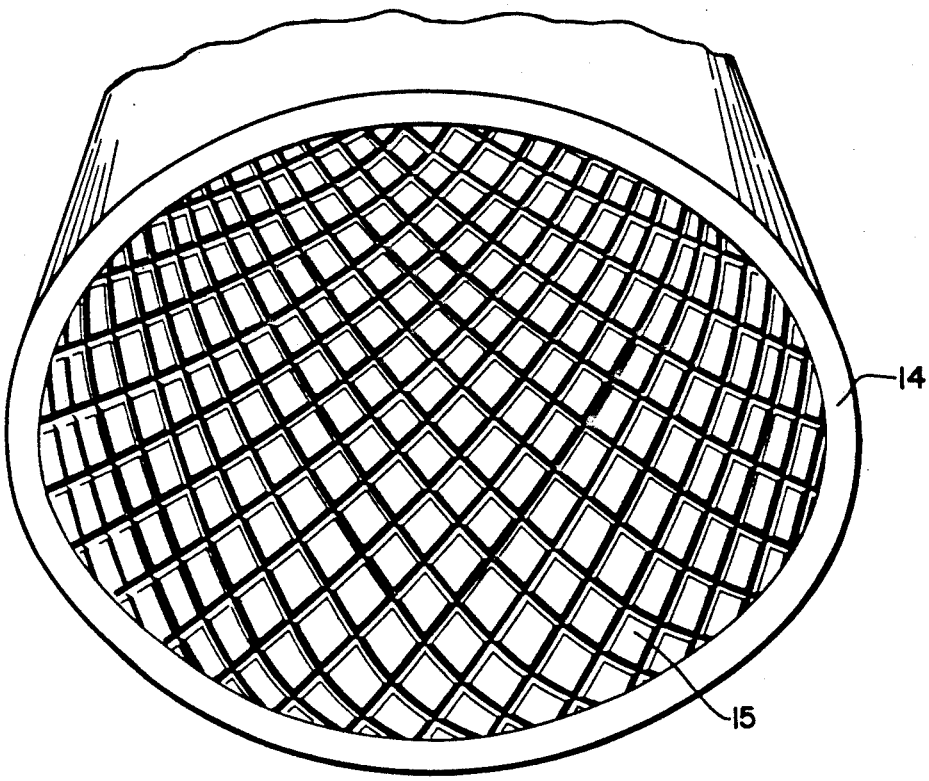
FIG. 14 illustrates a hollow cylinder having grooves on the inner surface.

The basic configuration of the fragment is determined by the geometry of the grid system used on the inner surface of the warhead case. For example, a family of parallel, longitudinal grooves will produce rod like fragments, while a diamond pattern, as shown in FIG. 14, will produce smaller fragments of predetermined shape and size. The actual size of the fragments resulting from a specific grid pattern will depend mainly on the wall thickness and the distance between the grid lines.

Figure 15:
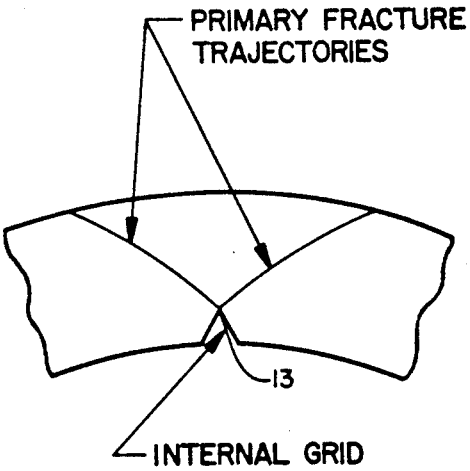
FIG. 15 (PRIOR ART)
FIG. 15 illustrates prior art.
Figure 16:
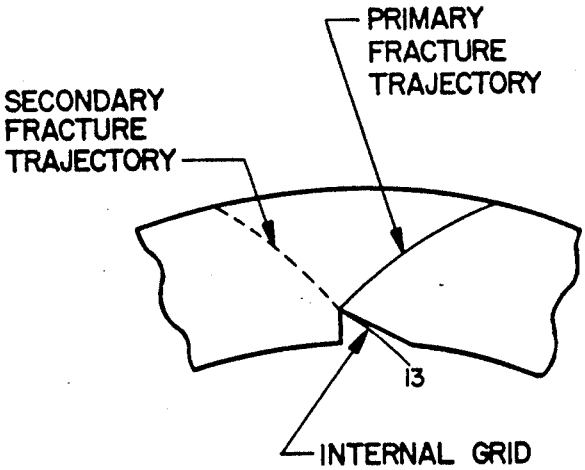
FIG. 16 illustrates controlled shear failure.

The shear trajectories emanate in mutually orthoganol pairs from the root of each element in the grid system as shown in FIGS. 15 and 16. Whether the controlled fractures tend to propagate along both trajectories, or are restricted to only certain trajectories of a specific orientation, is governed strongly by the cross sectional profile of the grid element or groove. Symmetrical profiles, such as sharp V grooves, tend to activate fractures along both trajectories. Non symmetrical profiles, such as a sawtooth groove configuration, tend to restrict the fractures to only one specific orientation of the trajectory pair. Thus, by changing the shape of the grid element profile, or by intermixing of different profiles in a given grid pattern, many different fragment configurations are available to the warhead designer. When the concept of the grid element profile is combined with the possibility of different grid system geometry, the designer has available a versatile method for fragmentation control.

The orientation of the detonation front relative to the shape of the grid element profile in a diamond pattern system is normally considered only when a non symmetrical profile is employed. Then the relative orientation between the detonation front and the profile configuration affects the number of preferred and nonpreferred trajectories which are activated. For a cylindrical warhead with single-point, end initiation, this becomes a factor in orienting the grid element profile relative to the detonator end.

The type of explosive is related to the fragmentation behavior of the warhead case through what most simply might be termed its "brisance" characteristic. Having fixed the above parameters for a given warhead case, the fragmentation characteristics will vary to a lesser degree with the type of explosive used. This variation will be determined by the relative number of fracture trajectories activated in the entire case, and for a non symmetrical profile by the relative activation of trajectories of preferred and nonpreferred orientation. In general, the greater the brisance of the explosive, the larger the total number of trajectories activated, and the increased tendancy to activate trajectories with a less preferred orientation. Within the range of military explosives studied with this method, however, fragmentation variations due to changing the explosive were much less important than the variations associated with changes in the other Parameters.

The presence of a buffer material between the explosive and the warhead case, such as a thin metal liner or sleeve, affects the activation of fractured trajectories. It can reduce the total number of trajcetories activated, and for a non symmetrical profile type of grid it can affect their activation ratio between preferred and nonpreferred trajectories. The affect of the buffer will vary considerably, depending upon its properties and thickness. For example, the use of a thin, hot-melt layer (cavity paint) such as is used with some of the cast explosives, appears to have little effect, while a one sixteenth inch-thick steel sleeve can cause a marked difference in the fragmentation behavior of the case.

Numerous types of manufacturing processes have been used to produce controlled grids for experimental warheads. In general these processes can be separated into two categories: (1) Machining operations where the metal is actually removed, and (2) embossing operations (deformation processing) where the metal is displaced. Differences in hardness and microstructure (grain deformation) may occur locally in the metal at the root of the grid element for these two categories of operations. Small geometrical differences may also occur in the grid which are associated with metal flow and types of grid production methods, and that the type of manufacturing process employed should be determined mainly by the economics of the problem rather than by possible minor variations in case behavior.

The two major considerations in planning the geometry of a grid system are (1) to design the grid in such a way that it utilizes the maximum strain conditions which exist in the warhead case, and (2) to use a grid geometry which maintains symmetry with respect to the strain field.

During the deformation and expansion of a cylindrical warhead case, the maximum strain occurs in the circumferential direction, with the axial or longitudinal strain being a much smaller value. Therefore, the grid design should be based primarily on the action of the circumferential rather than the axial strain. Thus, a grid system of parallel longitudinal grooves which utilizes the action of circumferential strain is highly effective in forming rod like fragments. On the other hand, a system which uses parallel circumferential grooves and relies on the action of longitudinal strain would normally be ineffective. To form small fragments, a diamond pattern is extremely effective. Here again, the grid should be designed to effectively utilize the action of the circumferential strain. Accordingly, a pattern having the diamonds elongated in the axial direction is far more effective than a pattern having the diamonds elongated in the circumferential direction. The most desirable angle to use for the diamond pattern becomes a compromise between having the angle small engough to get effective control, and at the same time having the angle large enough to form fragments with a desirable shape. An angle of 60 degrees has proven to be an excellent choice, although the angle may vary from 50 to 70 degrees and still produce acceptable results.

The fragmentation behavior of the warhead case is reasonably sensitive to the symmetry of the grid system with respect to the strain field. Thus, if all elements of the grid system use the action of the strain field to an equal degree, then each element can be expected to participate in a comparable fashion in the fragmentation of the case. If, however, the grid design is not symmetrical with respect to the strain field there is an imbalance in the utilization of the grid elements, so that those elements of the grid which are most preferentially oriented will predominate in controlling the formation of fragments.

It should be understood that if the warhead is of some shape other than cylindrical, then the strain field may have a different geometry and the grid pattern would have to be changed accordingly. However, regardless of the resulting grid geometry, it must still meet the requirements of (1) utilization of the maximum strain conditions, and (2) symmetry with respect to the strain field.

The grid profile configuration is the cross sectional shape of the individual grid element. In general, the grid element or groove profile is given by one of two basic shapes, it is either symmetrical or nonsymmetrical. The two basic profiles which have been used the most are a symmetrical V-notch having a 60 degree included angle, and a nonsymmetrical sawtooth shape having a 65 degree included angle, shown in FIGS. 15 and 16.

As described previously, the maximum shear trajectories emanate in mutually orthoganal pairs from the root 13 of each element in the grid system initially oriented 45° to a tangent to cylindrical curvature at the root. The concept of notch sensitivity in the shear-control method of fragmentation is related to activation of fractures along these trajectories. Whether the controlled fractures tend to propagate along both trajectories, or are restricted to only certain trajectories of a specific orientation, is governed mainly by the cross-sectional profile of the grid.

For steel warhead cases, symmetrical profiles tend to produce fractures in equal numbers along both trajectories, while nonsymmetrical profiles tend to restrict the fractures to only one orientation of the trajectory pair. Thus, the degree of sensitivity for a grid system with a symmetrical profile is related to the total number of trajectories activated relative to the total theoretical number of such trajectories which are possible in the warhead case, or in a specific section of the case. For a grid system with a non-symmetrical profile, the concept of sensitivity is somewhat further refined because the trajectories in an orthoganol pair take on a primary and a secondary behavioral feature. That is, they have a preferred and a nonpreferred orientation relative to the possibility of fracture, and the sensitivity can be described by the relative degree of activation on each type of trajectory.

The difference in fracture activation behavior between the symmetrical and nonsymmetrical profiles can be considered through the concept of a dynamic force balance where the internal loads acting over the surfaces of the shear trajectories are opposing the explosion producing loads acting over the inside surface of the case and the surfaces of the grid elements. Because of the geometry of the symmetrical profile, the external forces are developed in a symmetrical manner so that failure may occur equally over either one of the trajectory pair, and in some instances both trajectories may support failure simultaneously.

On the other hand, the geometry of the nonsymmetrical profile allows the external forces to develop in a manner to first overcome the internal resisting force associated with the primary trajectory. In considering the interaction of the internal and external forces, the directional effects and the dynamic aspects of load generation associated with the detonation process must be included. For lower strength material, such as some of the aluminum alloys in the "0" condition, the limiting magnitudes of the internal forces which can be generated on the different trajectories are all so low relative to the loads applied that all trajectories activate fracture regardless of profile shape. However, most steels have sufficiently high strength characteristics that the metal can differentiate between the failure requirements of the primary and secondary trajectories.

Figure 1:
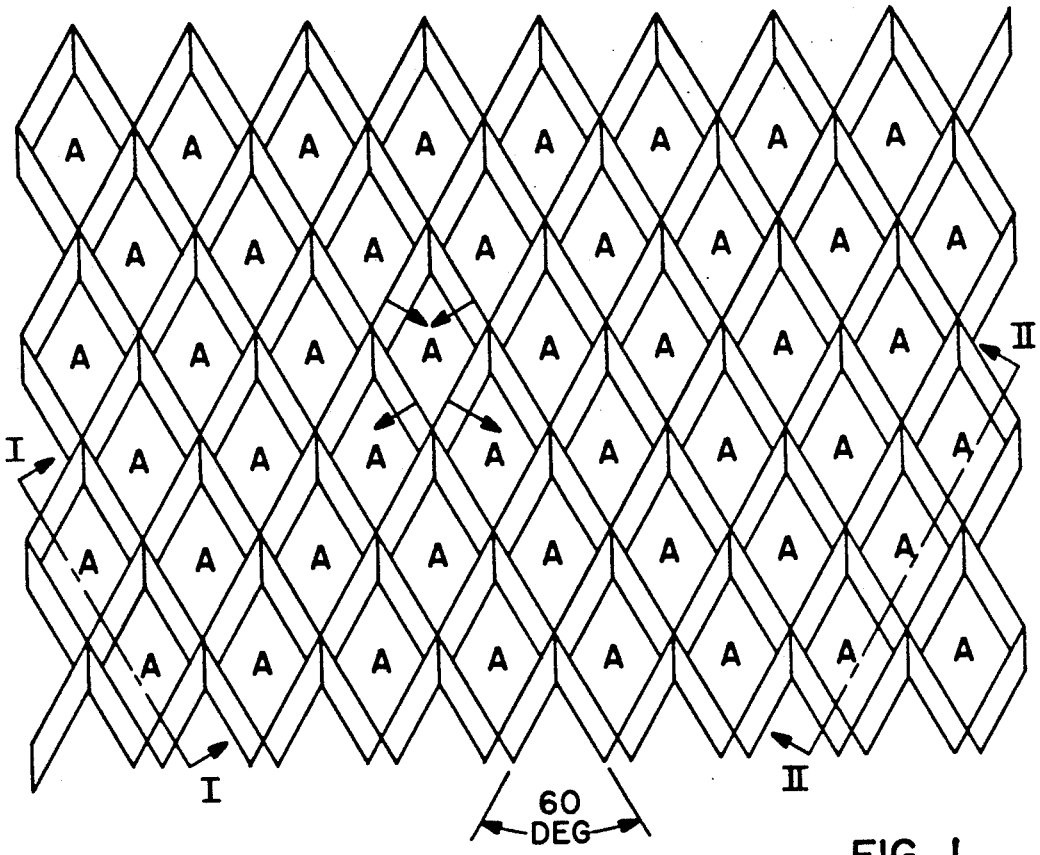
FIG. 1 illustrates a fracture grid designed to produce a single variety of fragments.
Figure 2:
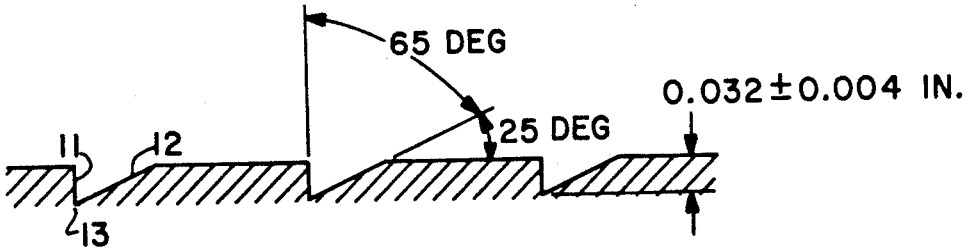
FIG. 2 illustrates groove profiles taken along line I—I.
Figure 3:
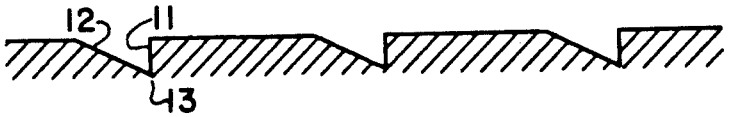
FIG. 3 illustrates groove profiles taken along line II—II.

FIG. 1 shows a diamond grid pattern using a nonsymmetrical profile. Specific grid dimensions given in FIG. 2 are typical. The 0.032 inch depth for the grooves was effectively used with many of the test cylinders, although grid depth values as low as 0.025 inch and as high as 0.045 inch provided effective control. If the grid lines are too close together relative to the case thickness, fragments having multiple diamonds are formed. At the other extreme, if the grid lines are too far apart, the larger fragments produced by the control method will, in turn, be broken into smaller pieces by the natural fragmentation process.

There are no sharp lines of demarcation to establish these boundaries. Rather, it is a gradual transition process in both directions. Between these two extremes there is a range of effective fragment sizes which can be obtained through the appropriate spacing of the grid lines. The width of this effective control range can be expected to vary with the properties of the case material, with ductility being an important parameter. In general, the greater the ductility, the wider the control range. An appropriate starting point for a diamond pattern is to make the grid spacings equal to the case thickness. The designer then has the leeway to enlarge or reduce the desired size of the fragment within the property limitations of the metal.

The grid design concept of this invention is more appropriate for use with the diamond pattern grid where the profile directions of the left-hand (positive pitch) and the right-hand (negative pitch) families or sets of spiral grooves can be varies. Two approaches can be used; (1) a grid designed to produce fragments of all one shape and size, but where the shape can be varied by changing the profile directions, and (2) a controlled fragment mix where fragment families of several different shapes can be produced in predetermined numbers. The latter approach allows for a preselected mixture of several different fragment shapes and fragment masses in predetermined mass ratios from a single warhead case. In this manner the warhead designer can meet the requirements for a specific mass distribution signature which peaks at one or at several fragment mass values.

FIG. 13 shows some typical fragment shapes which have been obtained through the intermixing of profile directions in diamond pattern grids. Starting with the diamond pyramid shaped fragment which is produced by the intersection of four primary trajectories, the fragment shape can be changed by the addition of from one to four wings. This is accomplished by changing the profile directions of specific parallel helical grooves in the left-hand and right-hand spiral families such that from one to four of the primary trajectories are reversed in direction. Two specific examples of experimental behavior, (1) a grid system which produces a fragment mass distribution plot having a single peak, but where the fragment shape is different from the shape produced by the grid of FIG. 1, and (2) a grid system which gives a fragment mass distribution plot with two distinct peaks, are illustrated in FIGS. 4 and 7 respectively.

Figure 4:
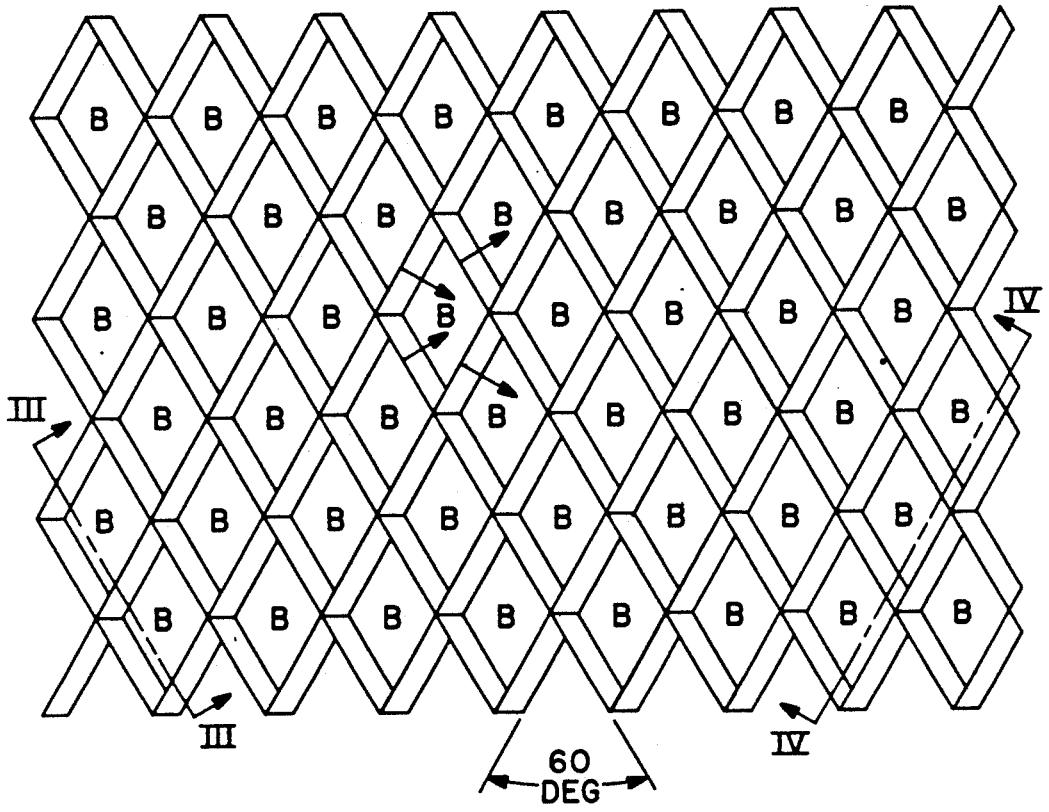
FIG. 4 illustrates a fracture grid designed to produce a single variety of fragments.
Figure 5:
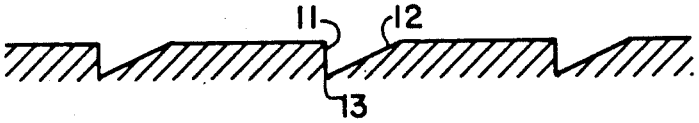
FIG. 5 illustrates groove profiles taken along line III—III.
Figure 6:
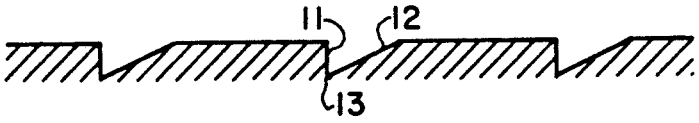
FIG. 6 illustrates groove profiles taken along line IV—IV.

FIG. 4 shows a grid designed to produce fragments of all one shape and size. The shape is that of a diamond with two wings attached to one side. A comparison with the grid of FIG. 1 shows that the shape change has been accomplished by reversing the profile direction for all of the grooves in one spiral family. The small arrows which appear in FIG. 2 represent the location and direction of the fracture surfaces as they form the fragments. The two converging arrows to the left of the diamond represent undercut fractures while the two diverging arrows to the right of the diamond represent wing fractures.

Figure 7:
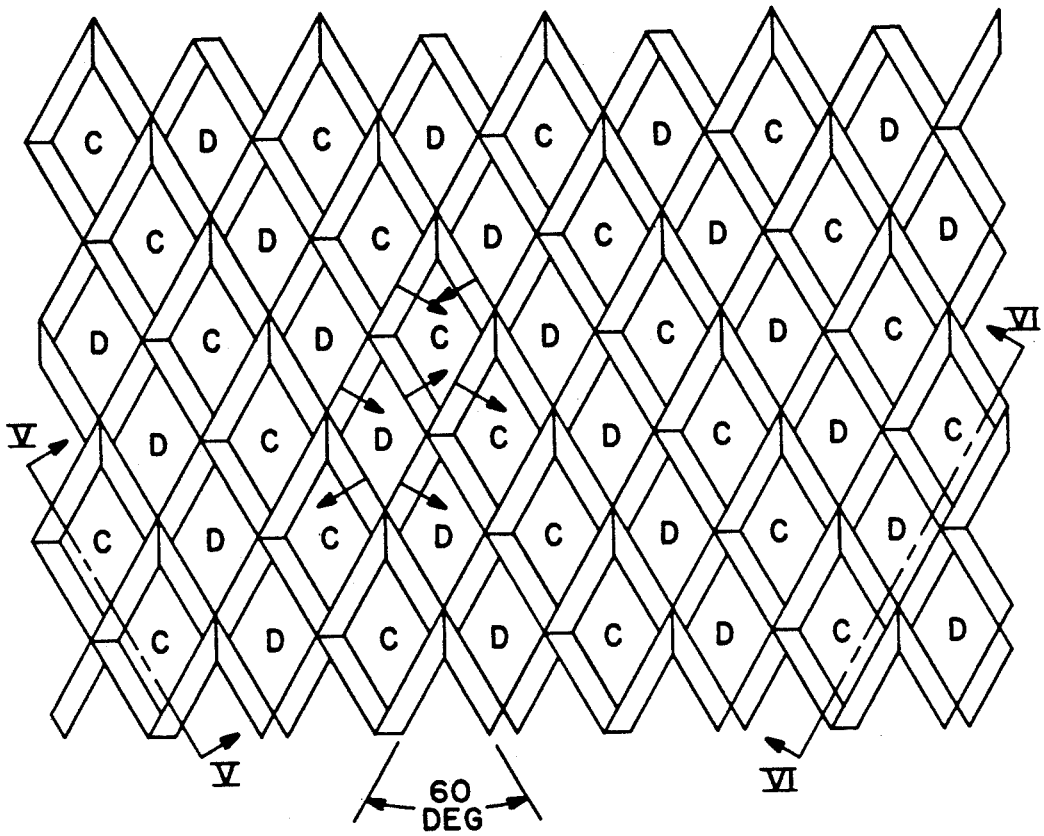
FIG. 7 illustrates a fracture grid designed to produce two varieties of fragments.
Figure 8:
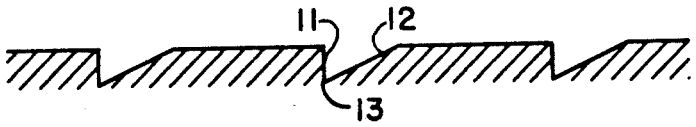
FIG. 8 illustrates groove profiles taken along line V—V.
Figure 9:
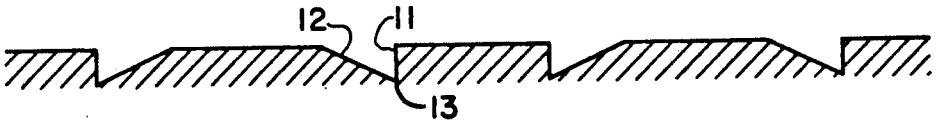
FIG. 9 illustrates groove profiles taken along line VI—VI.

The grid pattern shown in FIG. 7 was specifically designed to produce fragments having one of two different shapes; (1) a diamond having one wing, and (2) a diamond having three wings. These configurations are obtained by keeping all the grid profiles in the same direction for one spiral family of grooves, and alternating the direction of the grid profiles for the other spiral family of grooves. The grid is designed to produce equal numbers of fragments of both shapes. Since the theoretical mass of each fragment shape can be determined for a case with given wall thickness and grid spacing distances, quantitative values for the double peaks in the mass distribution plot can be predicted theoretically.

The locations where the two different fragment shapes originate in the grid design are given in FIG. 7. Again, the small arrows indicate the locations and directions of the shearing fractures in terms of undercut and wing producing fractures. It is seen that what is a wing cut for one fragment is also an undercut for an adjacent fragment, and vice versa. The single wing fragments are all formed by three undercut fractures and one wing fracture, while the triple wing fragments are formed by one undercut and three wing fractures.

Figure 10:
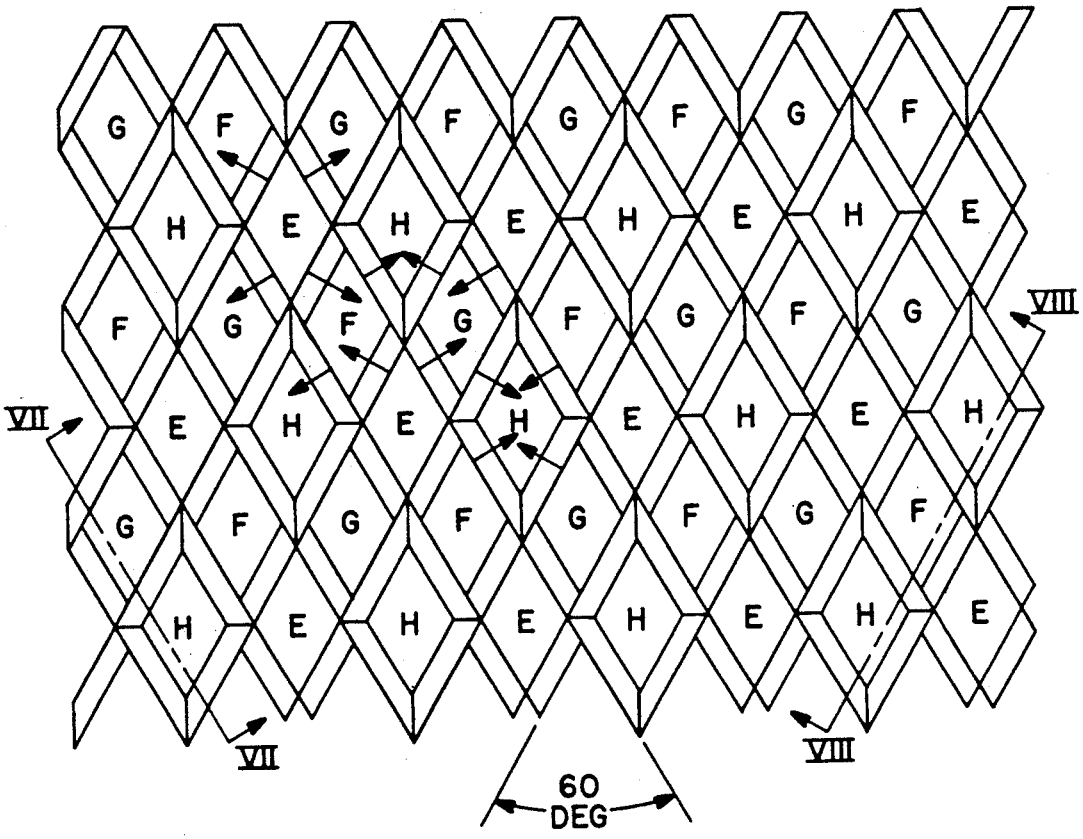
FIG. 10 illustrates a fracture grid designed to produce four varieties of fragments.
Figure 11:
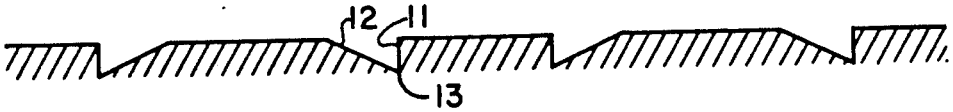
FIG. 11 illustrates groove profiles taken along line VII—VII.
Figure 12:
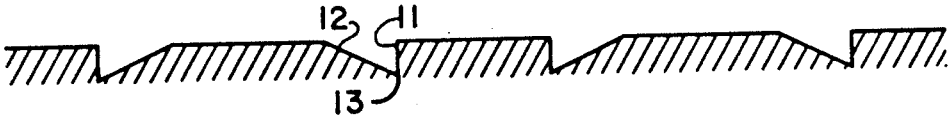
FIG. 12 illustrates groove profiles taken along line VIII—VIII.

Finally, the grid pattern shown in FIG. 10 was specifically designed to produce fragments of four different shapes; (1) a diamond shape having no wings, (2) a diamond shape having two diagonally opposed wings, (3) a diamond shape having two opposed wings which is the mirror image of the second shape, and (4) a diamond shape having four wings. The fragment shapes which are mirror images are, of course, of approximately equal mass, and therefore the grid design of FIG. 10 produces three characteristically different mass groupings. The distribution of fragments produced by FIG. 10 is obtained by arranging the grooves in each family or set so that the steep wall of each groove in each family of grooves is adjacent to the steep wall of an adjoining groove in that family.

Of course a single warhead may employ more than one grid design at different points on the warhead case in order to tailor the fragmentation yield to the targets anticipated.

TEST PROCEDURE

A series of four test cylinders was prepared to study a new concept in controlled fragmentation. Each of these test cylinders had a shear-control grid machined on the inner surface. However, each grid system was designed to give a different control pattern based on variations in the relative orientations of the nonsymmetrical grid profiles in the right-hand and left-hand families of spiral grooves.

FIGS. 1, 4, 7 and 10 are a repeat of the four grid designs used. The locations of different fragment shapes as they appear in the grid are indicated by letters in FIGS. 1, 4, 7 and 10. The arrows shown on each grid design represent the location and direction of the shearing surfaces as they form the fragment. Mass control of each fragment shape is exercised by the number of wings attached to a diamond pyramid, and is accomplished by activating only the primary trajectory of each trajectory pair which emanate from each individual grid element. Each of the four test cylinders had a grid with approximately 1,664 grid elements.

Each cylinder was 5-inch O.D. by 4½-inch I.D. by 10 inches long and was machined from a plain low carbon steel certified to be SAE 1015. Each cylinder was loaded with 9 pounds of Composition C-3 explosive and fired in the vertical position in a 15-foot radius fragment-recovery arena. Single-point, end initiation was used at the upper end of the cylinder. The cylinders were mounted on 57-inch high wooden stands, and the fragments were recovered in Celotex modules. Seven modules were used in each of the tests for Rounds 1–3, and eleven modules for Round 4. The increased number of modules for Round 4 was due to the fact that this round was designed to produce four different shapes of fragments and the extra modules were required to obtain a representative number of fragments for each of the four shapes.

HEAT TREATMENT

Chemical and metallographic checks of the steel were conducted even though it had been received as certified SAE 1015. The carbon analysis showed that it was actually SAE 1018, a little more carbon than was desired. Also, the steel was received with a hardness of $R_B$ 98 ($R_C$ 20), much harder than was desired. Accordingly, after the test cylinders had been machined they were heat treated at 1200° F. for 1½ hours and then air-cooled to reduce the hardness to about $R_B$ 84.

EXPERIMENTAL RESULTS

The results of the four test firings were in direct agreement with the theoretical results predicted.

Test Round No. 1 was used as a standard for comparing the behavior of the other rounds. This grid is designed to produce fragments of one shape, a diamond with two wings on the bottom, and is illustrated by FIG. 1.

A large array of two-wing fragments were all formed correctly in accordance with the control theory developed for this grid design. Some fragments showed the loss of one wing. Other small fragments are these missing wings. Wing "clipping" such as this is the result of activation on secondary shear trajectories and normally does not occur for the plain low-carbon steels. However, an increase in the carbon content appears to sensitize the shear trajectories to greater activation through adiabatic shear. When this happens some of the secondary trajectories become active and wing clipping occurs. A reduction in the carbon content should eliminate this effect.

Test Round No. 2—The grid for this test round (FIG. 4) was designed to give one fragment shape where two wings are located on one side of the diamond. This test was conducted to study the use of grid profile orientation as a means of changing the shape of the fragment but maintaining one single peak in the fragment mass distribution signature of the warhead.

A massive group of correctly formed fragments demonstrated the high degree of control obtained with this grid pattern. Several multiples were recovered, but their junctions were weak. Examination of the recovery modules showed that all of the multiples came from the same vertical location near the bottom end of the cylinder where the axial strain is a minimum during the expansion of an open-ended cylinder detonated at the other end. It is expected that for a fully cased warhead where the axial strain is greater, these multiples would not occur.

(C) Test Round No. 3—The grid of Round No. 3 (FIG. 7) was designed to produce fragments with two different shapes: (1) a diamond with one wing, and (2) a diamond with three wings. This would result in a double peak in the fragment mass distribution plot, a concept which can be employed against multiple targets. This design was extremely successful.

Test Round No. 4—This round had the most complicated grid pattern of the series (FIG. 10), and was designed to produce fragments in four different shapes: (1) a diamond with no wings, (2) a diamond with wings in the first and third quadrants, (3) a diamond with wings in the second and fourth quadrants, and (4) a diamond with four wings. Since both two-wing configurations would have the same theoretical mass, the fragment mass distribution plot should peak at three different mass values. Again, this is a grid design for use against targets where a controlled variety of mass values is desired.

The no-wing and four-wing fragments showed almost perfect control. Even the partial diamonds at the cylinder ends demonstrated proper control. Some of the two-wing fragments showed some wingclipping, the result of activation on the secondary trajectories. Again, as with Test Round No. 1, it is thought that a lower carbon content would reduce or eliminate the wing clipping effect. For this particular grid configuration with its complicated shear junctions, a plain low-carbon steel in the range of from SAE 1008 to SAE 1012 is recommended for future studies. If greater differences in the mass values of the different fragment shapes are required, this can be readily accomplished by adjusting the distances between the appropriate grid pairs.

FRAGMENT SHAPES

FIG. 13 shows representative fragments from each of the four test cylinders. The different fragment configurations are obtained by utilizing a basic diamond-pyramid shape and then attaching from one to four wings to the diamond. The number of wings attached to the diamond is controlled by the design of the grid, and more specifically by the orientations of the profiles of the four grid elements which bound each diamond in the pattern.

FIG. 13*a* shows the double-wing configuration A obtained with the grid pattern of FIG. 1. Both wings are attached at the bottom of the diamond. These fragments show how the control wings are attached to the basic diamond-pyramid shape. The average weight for fully formed fragments in this control group was about 82 grains.

FIG. 13*b* shows a different double-wing configuration B obtained with the grid pattern of FIG. 4. Here both wings are attached to one side of the diamond. The average weight for fully formed fragments in this control configuration was about 84 grains.

FIG. 13*c* shows the single-wing C and triple-wing D configurations obtained with the grid pattern shown in FIG. 7. Representative weights for fully formed fragments in these two control groups were about 75 grains for the single-wing fragments, and about 100 grains for the triple-wing fragments.

The four different fragment configurations resulting from the grid pattern of FIG. 10 are shown in FIG. 13*d*. The bottom fragment-H is the diamond-pyramid shape with no wings. The two middle fragments are two different configurations of double-wing fragments G and F. The top fragment is a four-wing fragment E. Representative weights for fully formed fragments in these control groups are: 60 grains for the diamond with no wings; 80 grains for the two-wing fragments in both configurations; and 105 grains for the four-wing fragments.

The results of these tests demonstrate the versatility of this new concept in providing (1) different configurations of fragments, and (2) a mixture of fragments from a given warhead having several predetermined fragment shapes and several predetermined fragment masses. In addition to the systems represented by FIGS.

1, 4, 7 and 10, other mixes of shapes and mass ratios can be obtained by different combinations of profile orientations and grid spacing distances. As a result of this study a warhead designer can now specify the requirements for a specific mass distribution signature which peaks at one or at several fragment mass values. Then, using the controlled fragment mix concept he can design the grid pattern to meet the fragmentation signature requirements of the warhead.

What is claimed is:

1. A frangible single-wall cylinder which yields a plurality of fragments having shapes and masses in ratios corresponding to a predetermined distribution upon explosive rupture, comprising:

a hollow cylinder having a longitudinal axis and an inner surface spaced a predetermined radial distance from said longtitudinal axis;

said inner surface defining a first set of parallel helical grooves having a first predetermined pitch and a second set of parallel helical grooves having a second predetermined pitch which is opposite in sign to said first predetermined pitch;

each groove in each of said first and second sets having a sectional profile defined by a first line which intersects said longitudinal axis, and a second line which intersects said first line at a point which is spaced from said longitudinal axis a distance which is greater than said predetermined radial distance, and intersects said first line at an angle within the range of from 60 to 70 degrees, said point of intersection defining the root of said groove profile;

each groove in said first set having the side defined by said first line positioned adjacent the side defined by said second line in a neighboring groove in said first set; and each groove in said second set having the side defined by said first line positioned adjacent the side defined by said first line in a neighboring groove in said second set.

2. The frangible single-wall cylinder as set forth in claim 1 wherein said cylinder is steel.

3. The frangible single-wall cylinder as set forth in claim 1 wherein said first and second predetermined pitches are selected to define a grid pattern of diamonds having a 50 to 70 degree included angle, and the major axis of said diamonds being parallel to said longitudinal axis.

4. A frangible single-wall cylinder which yields a plurality of fragments having shapes and masses in ratios corresponding to a predetermined distribution upon explosive rupture, comprising:

a hollow cylinder having a longitudinal axis and an inner surface spaced a predetermined radial distance from said longitudinal axis;

said inner surface defining a first set of parallel helical grooves having a first predetermined pitch and a second set of parallel helical grooves having a second predetermined pitch which is opposite in sign to said first predetermined pitch;

each groove in each of said first and second sets having a sectional profile defined by a first line which intersects said longitudinal axis, and a second line which intersects said first line at a point which is spaced from said longitudinal axis a distance which is greater than said predetermined radial distance, and intersects said first line at an angle within the range of from 60 to 70 degrees, said point of intersection defining the root of said groove profile;

each groove in said first set having the side defined by said first line positioned adjacent the side defined by said first line in a neighboring groove in said first set; and each groove in said second set having the side defined by said first line positioned adjacent the side defined by said first line in a neighboring groove in said second set.

5. The frangible single-wall cylinder as set forth in claim 4 wherein said cylinder is steel.

6. The frangible single-wall cylinder as set forth in claim 4 wherein said first and second predetermined pitches are selected to define a grid pattern of diamonds having a 50 to 70 degree included angle, and the major axis of said diamonds being parallel to said longitudinal axis.

* * * * *